US008026926B2

(12) United States Patent
Matsushima

(10) Patent No.: US 8,026,926 B2
(45) Date of Patent: Sep. 27, 2011

(54) IMAGE DISPLAY DEVICE AND IMAGE DISPLAY METHOD

(75) Inventor: Kenichi Matsushima, Chiba (JP)

(73) Assignee: Seiko Instruments, Inc., Chiba (JP)

( * ) Notice: Subject to any disclaimer, the term of this patent is extended or adjusted under 35 U.S.C. 154(b) by 885 days.

(21) Appl. No.: 12/032,372

(22) Filed: Feb. 15, 2008

(65) Prior Publication Data

US 2008/0231639 A1 Sep. 25, 2008

(30) Foreign Application Priority Data

Feb. 17, 2007 (JP) ..... 2007-037237
Apr. 24, 2007 (JP) ..... 2007-113908

(51) Int. Cl.
*G09G 5/02* (2006.01)

(52) U.S. Cl. ..... 345/589

(58) Field of Classification Search ..... 345/589
See application file for complete search history.

(56) References Cited

U.S. PATENT DOCUMENTS

| | | | | |
|---|---|---|---|---|
| 6,677,959 | B1 * | 1/2004 | James | 345/660 |
| 6,768,815 | B2 * | 7/2004 | Woodall | 382/162 |
| 6,961,066 | B2 * | 11/2005 | James | 345/589 |
| 7,019,756 | B2 * | 3/2006 | Park et al. | 345/589 |
| 7,388,998 | B2 * | 6/2008 | Han et al. | 382/274 |
| 7,414,682 | B2 * | 8/2008 | Shiota et al. | 349/114 |
| 2004/0239798 | A1 * | 12/2004 | Nayar et al. | 348/362 |
| 2005/0031199 | A1 * | 2/2005 | Ben-Chorin et al. | 382/162 |

FOREIGN PATENT DOCUMENTS

| | | |
|---|---|---|
| JP | 1-239589 A | 9/1989 |
| JP | 3430998 B2 | 5/2003 |

* cited by examiner

*Primary Examiner* — Ryan R Yang
(74) *Attorney, Agent, or Firm* — Brinks Hofer Gilson & Lione

(57) ABSTRACT

Provided is a structure in which an input image is normalized by a normalization value in a case where an amount of saturation is within an allowable range so as to adjust an intensity of a backlight according to the normalization value. Allowing slight saturation of an image thereby, effectively reduce the power consumption in the backlight.

34 Claims, 3 Drawing Sheets

IMAGE DISPLAY DEVICE AND IMAGE DISPLAY METHOD

REFERENCE TO THE RELATED APPLICATIONS

This application claims priority under 35 U.S.C. §119 to Japanese Patent Application Nos. JP2007-037237 filed Feb. 17, 2007, and JP2007-113908 filed Apr. 24, 2007, the entire contents of which are hereby incorporated by reference.

BACKGROUND OF THE INVENTION

1. Field of the Invention

The present invention relates to an image display device mounted on a mobile apparatus or the like such as a liquid crystal display device for displaying an image and relates to an image display method for the image display device.

2. Description of the Related Art

When an input image is dark for a display device, which displays an image through modulation of light from a light source, a method for saving power consumption of the light source without changing the brightness of the display image by increasing the brightness of the input image through normalization using the maximum value of a frame in the input image as shown in FIG. 2 and by combining a light source capable of emitting light proportional to the maximum value of the frame (see, for example, JP 01-239589 A).

Since the method is based on normalization using the maximum value of the entire frame abstracted in the maximum value abstractor 12 from the input image, change in quality in the displayed image is quite small. However, when there is at least one pixel with brightness which is close to the maximum, a brighter image cannot be obtained, resulting in a small power saving effect in an ordinary scene. Accordingly the method is used, for example, mainly in a large-screen television receiver required for higher image quality rather than lower power consumption.

A display device for a mobile apparatus is strongly thought to be a simple display for intermediate output in which the number of pixels and the display image size are smaller than those of a final output form such as actual image data, a hard copy, or the like. Accordingly even the image quality is somewhat reduced, a display device with small power consumption has tendency in desirability in view of battery life.

Thus, in recent years, in the case of the display device of mobile apparatus, a method of performing not only the normalization but also gamma conversion for obtaining a brighter image combined by simultaneous reduction of light from the light source to improve the power saving effect has been known as an application of the art. More specifically the darker the average brightness of the entire image is, the brighter the gamma conversion convert the image, adjusting the average brightness value to a value close to a target brightness value. In this case, the power consumption can be effectively reduced since many images can be converted into brighter images by the gamma conversion (see, for example, JP 3430998 B).

Though the power consumption of the light source can be effectively reduced according to the conventional method of performing the gamma conversion based on the average brightness of the input image, there is a problem in that a contrast thereof may be reduced through conversion of a dark input image into a brighter image by the gamma conversion. When the gamma conversion is performed while suppressing the reduction in contrast, there is a problem in that the amount of reduction in power consumption can not be enough.

In many cases, the display device mounted on a mobile apparatus is simply a display for intermediate output in which the number of pixels and the display image size are smaller than those of the final output form. The reduction in power consumption is rather required strongly for the display device on a mobile apparatus. Considering an actual dynamic range of a digital image with around 256 colors, the number of images with no saturation is small since many display images include illumination devices and glossy objects. In view of the circumstances, an optimum amount of saturation for the final output is not necessarily equal to an optimum amount of saturation for the intermediate output.

SUMMARY OF THE INVENTION

It is therefore an object of the present invention to realize an image display device and an image display method for a mobile apparatus which can significantly reduce power consumption of a light source without significant reduction in contrast even when some pixels are extremely bright by permitting slight saturation in normalization, thereby improving the entire balance.

According to the present invention, there is provided an image display device including: a normalizer for normalizing an input image; a normalization value calculator for receiving the input image and calculating a normalization value for normalization in the normalizer; a light adjuster for adjusting an intensity of light based on the normalization value obtained in the normalization value calculator; a light modulation display for modulating the light from the light adjuster to display the image normalized in the normalizer; and a controller for controlling the entire image display device.

In a similar manner, according to the present invention, there is provided an image display method including: a normalization step of normalizing an input image; a normalization value calculating step of receiving the input image and calculating a normalization value for normalization in the normalization step; a light source adjustment step of adjusting an intensity of light based on the normalization value obtained in the normalization value calculator; a light modulation display step of modulating the light in the light source adjustment step to display the image normalized in the normalization step; and a control step of controlling the entire image display device.

According to the present invention, it is possible to realize an image display device and an image display method in which the power consumption of a light source is significantly reduced without significant reduction in contrast of the displayer image even when an input image has some pixels which are extremely bright, since the optimum value is used as the normalization value for normalizing the input image, thereby improving the entire balance.

DETAILED DESCRIPTION OF THE PREFERRED EMBODIMENTS

Embodiment 1

Figure 1:
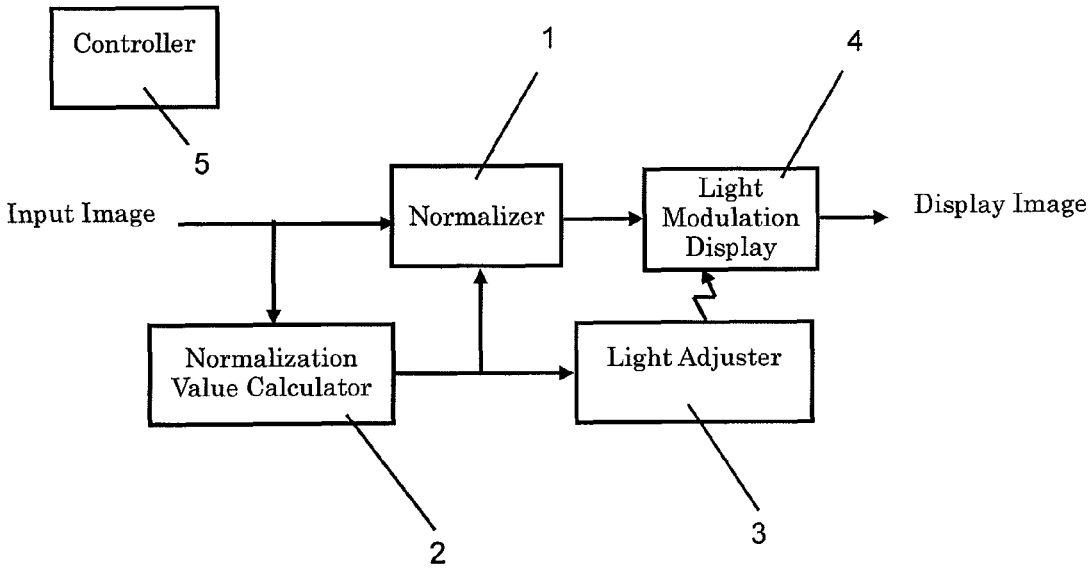
FIG. 1 is a block diagram showing an image display device according to Embodiment 1 of the present invention.
Figure 2:
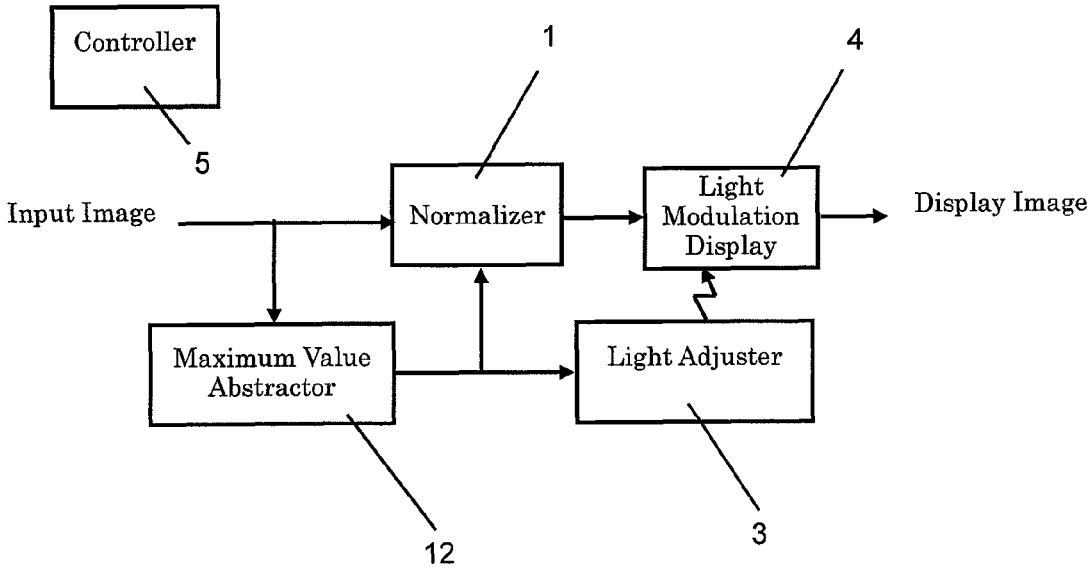
FIG. 2 is a block diagram showing a conventional image display device.

A preferred embodiment of the present invention will be described with reference to FIG. 1.

An image display device according to the present invention includes a normalizer 1 for normalizing an input image, a normalization value calculator 2 for receiving the input image and calculating a normalization value for normalization in the normalizer 1, a light adjuster 3 for adjusting an intensity of light based on the normalization value obtained in the normalization value calculator 2, a light modulation display 4 for modulating the light from the light adjuster 3 to display the image normalized in the normalizer 1, and a controller 5 for controlling the entire image display device.

In a similar manner, an image display method according to the present invention is achieved by including: a normalization step of normalizing an input image; a normalization value calculating step of receiving the input image and calculating a normalization value for normalization in the normalization step; a light source adjustment step of adjusting an intensity of light based on the normalization value obtained in the normalization value calculating step; a light modulation display step of modulating the light obtained in the light source adjustment step to display the image normalized in the normalization step; and a control step of controlling the entire image display device.

An input image is, for example, a photo image and normally expressed by brightness values L(X, Y) of pixels two-dimensionally arranged in a lateral direction X and a longitudinal direction Y. Each of the brightness values L(X, Y) is a digital value indicating the intensity of light, and the number of available values is finite. For example, in an eight-bit assignment, each of the brightness values takes one of 256 values of 0, 1, 2, . . . , 255.

Hereinafter, the respective units included in the image display device according to the present invention and the respective steps of the image display method therefor will be described in detail.

The normalization value calculator receives the input image and obtains an optimized normalization value required to perform the normalization in the normalizer in view of the entire balance between image quality and power consumption. The normalization value described here is a value taken from the brightness values of the input image and lineally converted to the maximum value permitted in the normalization. In other words, a brightness value of the input image larger than the normalization value goes to the maximum value or saturates.

Figure 4:
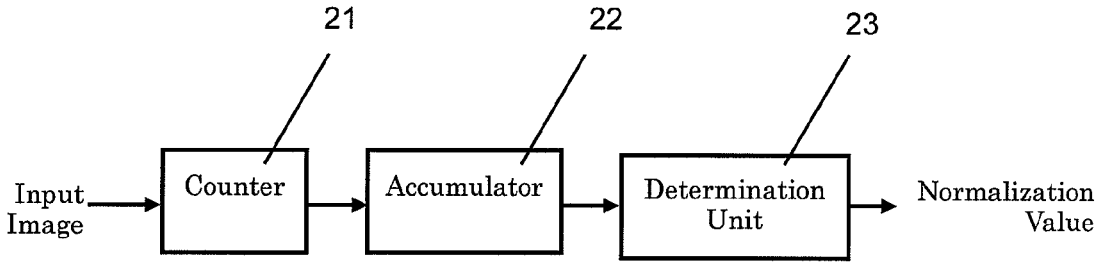
FIG. 4 is a block diagram showing a structure of a normalization value calculator.

As shown in FIG. 4, the normalization value calculator thus includes a counter 21, an accumulator 22, and a determination unit 23.

The input image enters to the counter 21. The number of pixels is counted for each of the brightness values L(X, Y) to thereby obtain a frequency distribution D(L) for each of the brightness L. To be specific, a memory D(L) whose volume is equal in number to the available values of the brightness values L is prepared. The frequency D of each of the brightness values L is initialized to 0. While the brightness values L(X, Y) are scanned in the lateral direction X and the longitudinal direction Y, as is expressed by Equation 1, a value of each of the memory D(L(X, Y)) is incremented to obtain the frequency distribution D(L).

$$D(L(X,Y))=D(L(X,Y))+1 \quad \text{(Eq. 1)}$$

The counter 21 generally obtains the frequency distribution D(L) of the entire region of the image. The frequency distribution D(L) may also be obtained for only a specific region of the image for which contrast is optimized. In order to change weight according to a region, for example, addition of a weight value may be performed instead of standard increment of adding one. Brightness difference, Laplacian, or the like may be calculated with peripheral pixels to change the value to be added, thereby increasing weight for the region whose change is significant, of the image.

The frequency distribution D(L) obtained by the counter 21 is sent to the accumulator 22. The accumulator 22 accumulates the frequency distribution D(L) for each of the brightness values L in descending order of brightness to obtain the accumulated frequency distribution R(L) or R2(L) as described below.

For example, when the brightness value L is expressed with eight bits, an accumulated frequency distribution R(255) is set to 0 in an initial condition. Then, the frequency distribution D(L) is accumulated acceding to Equation 2 in an order from the brightness value L of 254 to obtain the accumulated frequency distribution R(L). The accumulated frequency distribution R(L) obtained here corresponds to the number of pixels saturated in the case where the input image is normalized by the brightness value L.

$$R(L)=R(L+1)+D(L+1), \text{ where } R(255)=0 \quad \text{(Eq. 2)}$$

For example, as is expressed by Equation 3, the accumulator 22 may further perform the accumulation in a descending order from 254 to obtain the accumulated frequency distribution R2(L). The obtained accumulated frequency distribution R2(L) is a value obtained by accumulating the number of saturated pixels in an order from a larger brightness value L and corresponds to the degree of saturation.

$$R2(L)=R2(L+1)+R(L), \text{ where } R(255)=0 \quad \text{(Eq. 3)}$$

Accumulation of the frequency distribution D(L) using Equations 2 and 3 shows an example. Any method of obtaining the amount of saturation indicating a degree of saturation may be used.

The accumulated frequency distribution R(L) or R2(L) obtained as the amount of saturation in the accumulator 22 is sent to the determination unit 23. For example, as is expressed by Equation 4, the determination unit 23 compares the accumulated frequency distribution R(L) or R2(L) obtained as the amount of saturation with a predetermined allowable amount of saturation "A" in an order from the largest value of the brightness L to obtain, as a normalization value M, a maximum brightness value L at which the accumulated frequency distribution R(L) or R2(L) obtained as the amount of saturation does not exceed the allowable amount of saturation "A".

$$M=\text{Max}\ [L:\{R(L) \text{ or } R2(L))<A\}] \quad \text{(Eq. 4)}$$

In this case, only one of the accumulated frequency distributions R(L) and R2(L) may be used.

A predetermined constant value can be used as an allowable amount of saturation "A" in Equation 4. And a value which changes according to the brightness value L may also be used. For example, the allowable amount of saturation "A" can be set proportional to the brightness value L. To be specific, when the brightness value L is large, assuming a bright image, the allowable amount of saturation "A" is automatically increased. When the brightness value L is small, assuming a dark image, the allowable amount of saturation "A" is automatically reduced. Accordingly the normalization value M can be obtained based on the optimized allowable amount of saturation "A" corresponding to the brightness of the image.

When the brightness value L is expressed in eight bits, as expressed by Equation 5, for example, performing correction to increase the normalization value obtained by Equation 4 in the determination unit 23, an optimized normalization value can be obtained for significantly reducing the amount of saturation in the normalizer 1.

$$M=255-0.8\times(255-M) \quad \text{(Eq. 5)}$$

The case where all the brightness values L are separately processed in the counter 21, the accumulator 22, and the determination unit 23 has been described above as an example. A series of processings may, however, be performed for each of the brightness values L by the counter, the accumulator, and the determination unit in an order from the largest brightness value L and the processing of the normalization value calculator 2 may be completed when the normalization value M is obtained.

For example, in a case where some pixels are extremely bright, such as a case of a night view image, the normalization value M becomes a small value, thereby deteriorating brilliance included in a night view. In order to solve such a problem, a brightness value obtained by reducing a maximum pixel brightness value by, for example, 30% is set as a normalization value. Alternatively, a brightness value obtained by reducing 20% from the brightness value at which an accumulated frequency distribution reaches a predetermined value is set as a normalization value. Thus the normalization value can be dynamically set corresponding to an image.

The normalization value can also be calculated by the same method through the normalization value calculating step including the counting step, the accumulation step, and the determination step.

The normalizer 1 normalizes the brightness values L(X, Y) of each pixel of the input image I for each pixel based on the normalization value M obtained by the normalization value calculator 2 to obtain a normalization image F(X, Y). For example, the case of eight bits is expressed by Equation 6. Note that a value larger than 255, which is obtained by the normalization, is set to 255. After adding 0.5, an integer part is extracted through the function "int" is a round-off operation to obtain an integer value.

$$F(X,Y)=\text{int}\{L(X,Y)\times 255/M+0.5\} \quad \text{(Eq. 6)}$$

The normalization is performed to obtain a brighter image substantially inversely proportional to the normalization value M.

An image corresponding to one frame is normally required to calculate the normalization value by the normalization value calculator 2. When the input image is provided only once, the image corresponding to one frame may be stored in the normalizer 1, and the stored image may be normalized after the calculation of the normalization value M. When the same input mage can be provided twice, the normalization value M may be obtained by the normalization value calculator 2 from the input image which is firstly provided, and then the input image which is secondly provided may be normalized by the normalizer 1. When moving images are continuously provided, an input image corresponding to a current frame may be normalized by the normalizer 1 based on the normalization value M obtained by the normalization value calculator 2 from an input image corresponding to a preceding frame.

The normalization can be also realized by the same method through the normalization step.

The light adjuster 3 generates light for display and emits the generated light to the light modulation display 4. The light adjuster 3 adjusts an intensity of light according to a bright image which is converted by the normalizer 1. The normalization image is converted into a bright image substantially in inverse proportion to the normalization value M by the normalizer 1. Accordingly, the intensity of light may be changed by the light adjuster 3 in proportion to the normalization value M. Thus, the image can be displayed without substantially changing apparent brightness.

The light for display can also be realized through the light source adjustment step by changing the intensity of light by the same method.

The light modulation display 4 adjusts transmittance or reflectance according to the normalization image F(X, Y) from the normalizer 1 to modulate the light from the light adjuster 3, thereby displaying the image. In this embodiment, the example in which the light is modulated using a liquid crystal device to display the image is described. However, the present invention is not limited to this example.

The light modulation display can also be realized through the optical modulation display step for display using the same method.

The controller 5 controls, for example, a status and a sequence of the entire image display device.

In the control step, the status and the sequence of the entire image display device are similarly controlled.

As described above, according this embodiment, the normalization value for performing the optimum normalization is obtained by the normalization value calculator in view of the balance between image quality and power consumption. The normalization can be performed by the normalizer to increase the brightness of the image substantially in inverse proportion to the normalization value. The amount of light from the light source can be adjusted by the light adjuster to the amount of light substantially proportional to the normalization value. The power consumption of the light source can thus be reduced without substantially changing the brightness of an apparent display image. In other words, when an object image of the input image includes some pixels which are extremely bright, such as an image pixel of illumination light and an image pixel of a gloss, the pixels which are extremely bright are saturated. Accordingly, although the image quality is slightly deteriorated by the saturation, the power consumption of the light source can be significantly reduced.

The example of the image display device for displaying the monochrome image is described. Even in the case of a color image, for example, a frequency distribution is produced from all color constituent components by the counter, or a frequency distribution is produced after the conversion into the monochrome image. Accordingly, when the same method as that in the case of the monochrome image is used for the other constituent units, the power consumption can be significantly reduced without significantly changing the brightness and the image quality of the display image.

Figure 5:
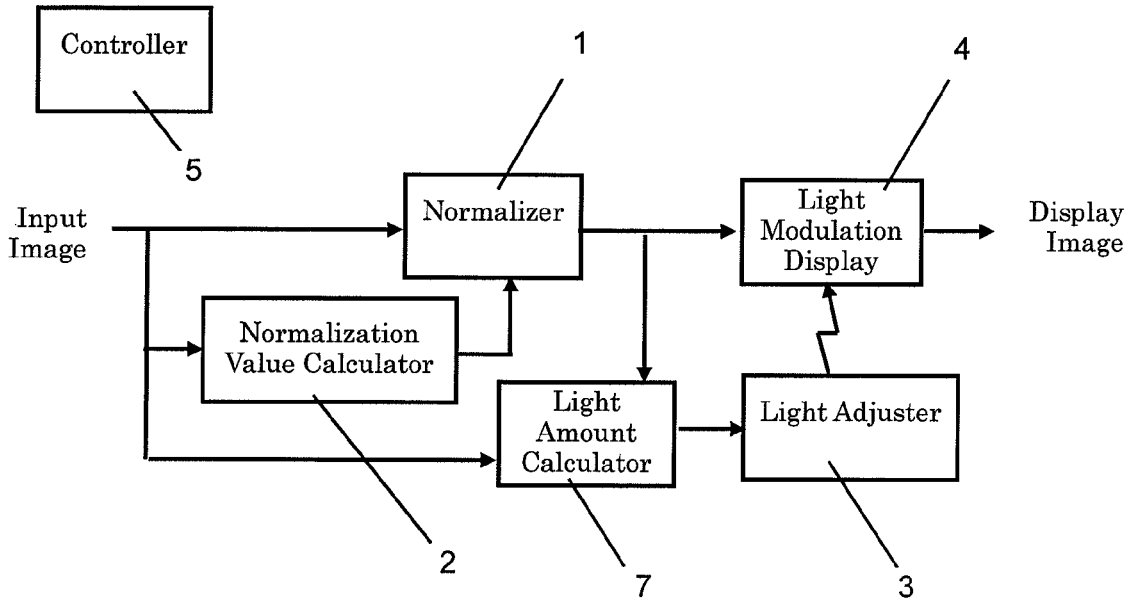
FIG. 5 is a block diagram showing an example of the image display device according to Embodiment 1 of the present invention.

The case where the intensity of light is adjusted by the light adjuster 3 substantially in proportion to the normalization value is described as an example. In this example, the brightness of a region which does not saturate, of the display image is not changed. Accordingly, when a saturated region becomes darker, the brightness of the entire frame tends to become slightly dark. When the brightness of the entire frame including the saturated region is adjusted to a substantially constant value, for example, as shown in FIG. 5, the input image and an image sent from the normalizer 1 are sent to a light amount calculator 7. An average brightness value between images before and after the processing of the normalizer 1 is obtained by the light amount calculator 7. A light amount value proportional to a ratio at which the brightness of an image is increased by the normalizer 1 is sent to the light adjuster 3. Thus, the image can be more accurately displayed without changing apparent brightness. When a ratio at which the average brightness value changes is to be obtained, for example, a frequency distribution after the normalization is estimated based on the frequency distribution obtained by the counter 21 of the normalization value calculator 2 and both the frequency distributions are used. Any unit capable of obtaining the brightness change ratio may be employed.

The degree of darkening caused by saturation corresponds to the allowable amount of saturation used in the determination unit 23 of the normalization value calculator 2. Consequently, the intensity of light emitted from the light adjuster may be finely adjusted based on the allowable amount of saturation.

Embodiment 2

The device and method in which the bright image is obtained by the normalization using the optimum normalization value to reduce the power consumption of the light source are described in Embodiment 1. In Embodiment 2 of the present invention to be described next, the device and method as described in Embodiment 1 are combined with a structure for reducing the power consumption of the light source using brightness conversion which is conventionally known to simultaneously solve the problems of both structures. Thus, degradation in image quality can be minimized to further reduce the power consumption.

Figure 3:
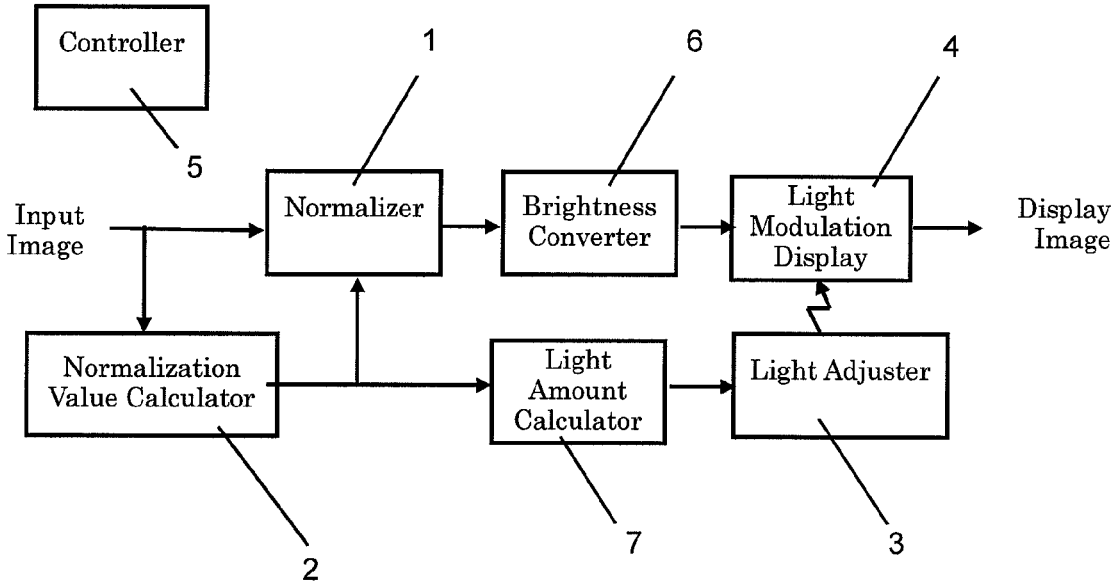
FIG. 3 is a block diagram showing an image display device according to Embodiment 2 of the present invention.

Thus, as shown in FIG. 3, an image display device according to Embodiment 2 further includes a brightness converter 6 and the light amount calculator 7 in the image display device according to Embodiment 1 of the present invention.

An image display method according to Embodiment 2 further includes a brightness converting step and a light amount calculating step in addition to the image display method according to Embodiment 1.

Hereinafter, the respective units and steps further included in Embodiment 2 will be described in detail. The other units and steps are substantially identical to those of Embodiment 1.

The brightness converter 6 converts the image normalized by the normalizer 1 into a bright image by brightness conversion such as gamma conversion and outputs the bright image to the light modulation display 4.

With respect to a characteristic of the brightness conversion, for example, gamma conversion based on a constant value corresponding to the degree of reduction in power consumption is used. Alternatively, gamma conversion based on a gamma value for approaching an average value of the entire image to a preset target value is used. Any brightness conversion for increasing the brightness of the image without significantly changing the appearance thereof may be used.

The brightness converter 6 calculates, by, for example, Equation 7, a ratio R at which the brightness of the image is increased before and after the brightness conversion, and outputs the ratio R to the light amount calculator 7.

$$R=(\text{average image brightness after conversion})/(\text{average image brightness before conversion}) \quad \text{(Eq. 7)}$$

The ratio can be easily obtained based on a histogram of the brightness of the image and the characteristic of the brightness conversion. Any method of obtaining the ratio based on the average brightness of the entire image may be employed.

As in the case of the normalizer 1, when it is necessary to store an image corresponding to one frame in order to obtain the characteristic of the brightness conversion and the ratio R for brightness by the brightness converter 6, the image stored in the normalizer 1 may be commonly used. In this case, the characteristic of the brightness conversion and the ratio R for brightness are preferably obtained corresponding to the normalization value used in the normalizer 1.

The brightness conversion can also be realized by the same method through the brightness converting step.

The light amount calculator 7 calculates a combined light amount value by, for example, Equation 8, based on the normalization value M obtained by the normalization value calculator 2 and the ratio R for brightness obtained by the brightness converter 6.

$$(\text{combined light amount value})=M/R \quad \text{(Eq. 8)}$$

In this case, the example in which the combined light amount value is obtained by division is described. When the ratio R for brightness from the brightness converter 6 corresponds to a reciprocal thereof, the ratio R can be obtained by multiplication.

The amount of light can also be calculated through the light amount calculating step executed using the same method.

As described above, according to the image display device of Embodiment 2, the normalization value for performing the optimum normalization is obtained by the normalization value calculator 2 in view of the balance between image quality and power consumption. The normalization is performed by the normalizer 1 to increase the brightness of the image substantially in inverse proportion to the normalization value. In addition, the brightness of the image is increased by the brightness conversion using the brightness converter 6. The combined light amount value is calculated by the light amount calculator 7 based on the normalization value and the brightness ratio before and after the conversion performed by the brightness converter 6. The amount of light from the light adjuster 3 is adjusted to be substantially in proportion to the combined light amount value. The light from the light adjuster 3 is modulated based on the bright image obtained by the brightness converter 6 to display the image on the light modulation display 4.

Consequently, according to Embodiment 2, while each of the amount of saturation of the image which is caused by the normalization and the amount of reduction in contrast which is caused by the brightness conversion is held within an allowable range, the power consumption is reduced in proportion to a combination of normalization and brightness conversion in each of which the image is converted into a bright image. Thus, the power consumption of the light source can be significantly reduced without significantly changing the brightness of an apparent display image and the image quality thereof.

Figure 6:
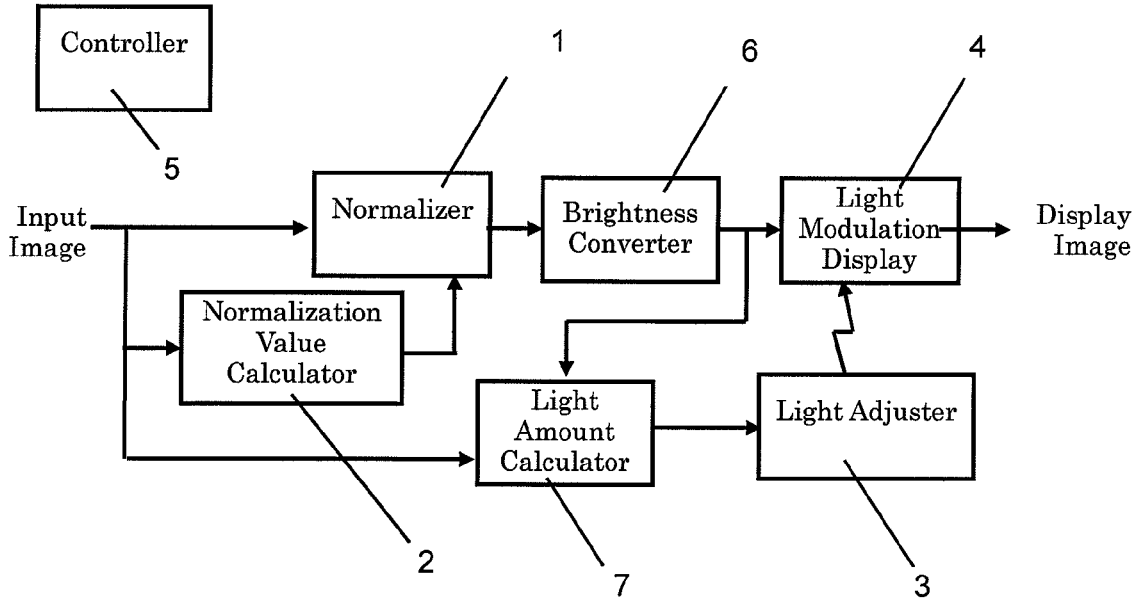
FIG. 6 is a block diagram showing an example of the image display device according to Embodiment 2 of the present invention.

In order to adjust the brightness of the entire frame including the saturated region to a substantially constant value as in the case of Embodiment 1, as shown in FIG. 6, the light amount calculator 7 outputs, to the light adjuster 3, a value inversely proportional to an image brightness increase ratio between the normalizer 1 and the brightness converter 6, which is obtained based on the brightness of an image provided to the normalizer 1 and the brightness of an image sent from the brightness converter 6. Accordingly, the image can be more accurately displayed without changing apparent brightness. Even in such a case, as in the case of Embodiment 1, a brightness change ratio is obtained based on a change in frequency distribution. Any unit capable of obtaining the brightness change ratio may be employed.

What is claimed is:

1. An image display device for displaying an input image, comprising:

a normalization value calculator for obtaining, from the input image, a normalization value for normalization by saturating the input image, wherein the normalization value calculator comprises:

a counter for counting the input image to generate a frequency distribution;

an accumulator for accumulating the frequency distribution to obtain a saturation amount; and determination means for determining the normalization value so as to hold the saturation amount within an allowable range;

a normalizer for normalizing the input image by the normalization value;

a light adjuster for adjusting an intensity of light for displaying based on the normalization value so as to compensate a change in brightness of an image obtained by the normalizer; and a light modulation display for modulating the light from the light adjuster based on changing one of transmittance and reflectance, to display the image sent from the normalizer.

2. An image display device according to claim 1, wherein, when the frequency distribution is generated by the counter, a different value is added corresponding to a position of the image.

3. An image display device according to claim 1, wherein, when the frequency distribution is generated by the counter, a different value is added based on a difference with a peripheral pixel value.

4. An image display device according to claim 1, wherein the accumulator accumulates the frequency distribution once in an order from a brighter pixel to obtain a saturation amount corresponding to the number of saturated pixels.

5. An image display device according to claim 1, wherein the accumulator accumulates the frequency distribution twice in an order from a brighter pixel to obtain the saturation amount corresponding to a degree of saturation.

6. An image display device according to claim 1, wherein the determination means compares the saturation amount with an allowable saturation amount to determine the normalization value.

7. An image display device according to claim 6, wherein the allowable saturation amount comprises one of a fixed value and a value determined based on a brightness value compared by the determination means.

8. An image display device according to claim 1, wherein the determination means compares the saturation amount with an allowable saturation amount and increases the normalization value such that the saturation amount is smaller than a value obtained by comparison.

9. An image display device according to claim 1, wherein the determination means determines the normalization value such that the normalization value is not smaller than one of a lower limit value obtained from a brightest pixel value of the input image and a lower limit value obtained from a brightness value when the saturation amount is a predetermined value.

10. An image display device according to claim 1, wherein the saturation amount corresponds to a number of saturated pixels and is obtained by the accumulator based on the frequency distribution.

11. An image display device according to claim 1, wherein the saturation amount corresponds to a degree of saturation and is obtained by the accumulator based on the frequency distribution.

12. An image display device according to claim 1, wherein the intensity of the light is changed according to the normalizing value which normalizes the inputted image so as to control the saturation amount corresponding to a number of saturated pixels.

13. An image display device according to claim 1, wherein the intensity of the light is changed according to the normalizing value which normalizes the inputted image so as to control the saturation amount corresponding to a degree of saturation.

14. An image display device for displaying an input image, comprising:

a normalization value calculator for obtaining, from the input image, a normalization value for normalizing by saturating the input image;

a normalizer for normalizing the input image by the normalization value;

a light amount calculator for calculating a light amount value based on a value corresponding to brightnesses of the image before and after an operation in the normalizer so as to compensate a change in brightness of an image obtained by the normalizer;

a light adjuster for adjusting an intensity of light for displaying based on the light amount value; and a light modulation display for modulating the light from the light adjuster based on changing one of transmittance and reflectance, to display the image sent from the normalizer.

15. An image display device for displaying an input image, comprising:

a normalization value calculator for obtaining, from the input image, a normalization value for normalizing by saturating the input image;

a normalizer for normalizing the input image by the normalization value;

a brightness converter for converting a brightness of the image normalized by the normalizer and obtaining a brightness ratio of the image before and after a brightness conversion;

a light amount calculator for calculating a combined light amount value so as to compensate a change in brightness of each of the images obtained by the normalizer and the brightness converter;

a light adjuster for adjusting an intensity of light for displaying based on the combined light amount value; and a light modulation display for modulating the light from the a light adjuster based on changing one of transmittance and reflectance, to display the image with the brightness converted by the brightness converter.

16. An image display device according to claim 15, wherein the light amount calculator calculates the combined light amount value based on an image brightness change ratio in the normalizer and an image brightness change ratio in the brightness converter.

17. An image display device according to claim 15, wherein the light amount calculator calculates the combined light amount value based on a value corresponding to a brightness of an image provided to the normalizer and a value corresponding to a brightness of an image sent from the brightness converter.

18. An image display method of displaying an input image, comprising:

a normalization value calculating step of obtaining, from the input image, a normalization value for normalization by saturating the input image, wherein the normalization value calculating step comprises:

a counting step of counting the input image to generate a frequency distribution;

a accumulation step of accumulating the frequency distribution to obtain a saturation amount; and a determination step of determining the normalization value so as to hold the saturation amount within an allowable range;

a normalization step of normalizing the input image by the normalization value;

a light source adjustment step of adjusting an intensity of light for display based on the normalization value so as to compensate for a change in brightness of an image obtained in the normalization step; and a light modulation display step of modulating the light obtained in the light source adjustment step based on one of transmittance and reflectance to be changed, to display the image sent from the normalization step.

19. An image display method according to claim 18, wherein, when the frequency distribution is generated in the counting step, a different value is added corresponding to a position of the image.

20. An image display method according to claim 18, wherein, when the frequency distribution is generated in the counting step, a different value is added based on a difference with a peripheral pixel value.

21. An image display method according to claim 18, wherein the accumulation step comprises accumulating the frequency distribution once in an order from a brighter pixel to obtain a saturation amount corresponding to the number of saturated pixels.

22. An image display method according to claim 18, wherein the accumulation step comprises accumulating the frequency distribution twice in an order from a brighter pixel to obtain the saturation amount corresponding to a degree of saturation.

23. An image display method according to claim 18, wherein the determination step comprises comparing the saturation amount with an allowable saturation amount to determine the normalization value.

24. An image display method according to claim 23, wherein the allowable saturation amount comprises one of a fixed value and a value determined based on a brightness value compared in the determination step.

25. An image display method according to claim 18, wherein the determination step comprises comparing the saturation amount with an allowable saturation amount and increasing the normalization value such that the saturation amount is smaller than a value obtained by comparison.

26. An image display method according to claim 18, wherein the determination step comprises determining the normalization value such that the normalization value is not smaller than one of a lower limit value obtained from a brightest pixel value of the input image and a lower limit value obtained from a brightness value when the saturation amount is a predetermined value.

27. An image display method according to claim 18, wherein the saturation amount corresponding to a number of saturated pixels and is obtained at the accumulation step based on the frequency distribution.

28. An image display method according to claim 18, wherein the saturation amount corresponding to a degree of saturation is obtained by the accumulation means based on the frequency distribution.

29. An image display method according to claim 18, wherein the intensity of the light is changed according to the normalizing value which normalizes the inputted image so as to control the saturation amount corresponding to a number of saturated pixels.

30. An image display method according to claim 18, wherein the intensity of the light is changed according to the normalizing value which normalizes the inputted image so as to control the saturation amount corresponding to a degree of saturation.

31. An image display method of displaying an input image, comprising:

a normalization value calculating step of obtaining, from the input image, a normalization value for normalization by saturating the input image;

a normalization step of normalizing the input image by the normalization value;

a light amount calculating step of calculating a light amount value based on a value corresponding to brightnesses of the image before and after an operation in the normalization step so as to compensate a change in brightness of an image obtained in the normalization step;

a light source adjustment step of adjusting an intensity of light for displaying based on the light amount value; and a light modulation display step of modulating the light obtained in the light source adjustment step based on changing one of transmittance and reflectance, to display the image sent from the normalization step.

32. An image display method of displaying an input image, comprising:

a normalization value calculating step of obtaining, from the input image, a normalization value for normalization by saturating the input image;

a normalization step of normalizing the input image by the normalization value;

a brightness converting step of converting a brightness of the image normalized in the normalization step and obtaining an image brightness ratio before and after conversion;

a light amount calculating step of calculating a combined light amount value so as to compensate a change in brightness of each of the images obtained in the normalization step and the brightness converting step;

a light source adjustment step of adjusting an intensity of light for display based on the combined light amount value; and a light modulation display step of modulating the light in the light source adjustment step based on changing one of transmittance and reflectance, to display the image with the brightness converted in the brightness converting step.

33. An image display method according to claim 32, wherein the light amount calculating step comprises calculating the combined light amount value based on an image brightness change ratio in the normalization step and an image brightness change ratio in the brightness converting step.

34. An image display method according to claim 32, wherein the light amount calculating step comprises calculating the combined light amount value based on a value corresponding to brightness of an image provided in the normalization step and a value corresponding to brightness of an image sent from the brightness converting step.

* * * * *